US011845279B2

(12) United States Patent
Yamamoto et al.

(10) Patent No.: US 11,845,279 B2
(45) Date of Patent: Dec. 19, 2023

(54) LIQUID DISCHARGE HEAD

(71) Applicant: BROTHER KOGYO KABUSHIKI KAISHA, Nagoya (JP)

(72) Inventors: Jiro Yamamoto, Nagoya (JP); Yasuhiro Sekiguchi, Nagoya (JP); Yoshitsugu Morita, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 27 days.

(21) Appl. No.: 17/526,561

(22) Filed: Nov. 15, 2021

(65) Prior Publication Data

US 2022/0153024 A1 May 19, 2022

(30) Foreign Application Priority Data

Nov. 17, 2020 (JP) ..... 2020-191111

(51) Int. Cl.
*B41J 2/145* (2006.01)

(52) U.S. Cl.
CPC ..... *B41J 2/145* (2013.01)

(58) Field of Classification Search
CPC ..... B41J 2/145; B41J 2002/14306; B41J 2002/14419; B41J 2002/14459; B41J 2/14233
See application file for complete search history.

(56) References Cited

U.S. PATENT DOCUMENTS

2008/0036824 A1* 2/2008 Ishikawa ..... B41J 2/161 347/71
2008/0303862 A1 12/2008 Ito
2019/0291443 A1* 9/2019 Katayama ..... B41J 2/175

FOREIGN PATENT DOCUMENTS

JP 2004-223880 A 8/2004
JP 2008-279690 A 11/2008

OTHER PUBLICATIONS

IP.com search (Year: 2023).*

* cited by examiner

*Primary Examiner* — Lisa Solomon
(74) *Attorney, Agent, or Firm* — KENEALY VAIDYA LLP

(57) ABSTRACT

There is provided a liquid discharge head including: a plurality of nozzles arranged in a first direction; a plurality of pressure chambers; a plurality of throttles; and a common channel extending in the first direction and connected to the plurality of throttles. The common channel has: a supply port, and a terminal part which is at least one of both end parts in the first direction of the common channel, the supply port being not provided at the terminal part. A terminal throttle which is one of the plurality of throttles and which is positioned closest to the terminal part among the plurality of throttles has a channel resistance same as a channel resistance of a throttle of the plurality of throttles different from the terminal throttle, and extends from a connection between the terminal throttle and one of the plurality of pressure chambers to the terminal part.

9 Claims, 5 Drawing Sheets

LIQUID DISCHARGE HEAD

CROSS REFERENCE TO RELATED APPLICATIONS

The present application claims priority from Japanese Patent Application No. 2020-191111, filed on Nov. 17, 2020, the disclosure of which is incorporated herein by reference in its entirety.

BACKGROUND

The present disclosure relates to a liquid discharge head configured to discharge or eject a liquid from a nozzle.

As an example of the liquid discharge head configured to discharge a liquid from a nozzle, there is known an ink-jet head configured to discharge an ink from a nozzle. Such an ink-jet head may have a plurality of nozzles, a plurality of pressure chambers each of which is provided individually with respect to one of the plurality of nozzles, and which communicates with one of the plurality of nozzles corresponding thereto, and a plurality of throttle parts each of which is provided individually with respect to one of the plurality of pressure chambers, which is connected to one of the plurality of pressure chambers corresponding thereto, and which extends in a direction orthogonal to one direction. Each of the plurality of nozzles, the plurality of pressure chambers and the plurality of throttles may be aligned in the one direction. Further, such an ink-jet head may have a common ink chamber extending in the one direction and connected to the plurality of throttle parts. An ink may be supplied to the common ink chamber from an ink supply hole which is provided on an end part, of the common ink chamber, which is on one side in the one direction.

Among the plurality of throttle parts, throttle parts which are different from a throttle part located on the other side of any other throttle parts in the one direction, may be directly connected to the common ink chamber. Among the plurality of throttle parts, the throttle part which is located on the other side of any other throttle parts in the one direction may be connected to the common ink chamber via an additional channel. The additional channel may extend in the one direction, and may be connected to an end part, of the common ink chamber, which is on the other side in the one direction.

SUMMARY

According to an aspect of the present disclosure, there is provided a liquid discharge head including a plurality of nozzles, a plurality of pressure chambers, a plurality of throttles, and a common channel.

The plurality of nozzles is arranged in a first direction.

The plurality of pressure chambers is each provided individually with respect to one of the plurality of nozzles so as to communicate with the one of the plurality of nozzles, and is arranged in the first direction.

The plurality of throttles is each provided individually with respect to one of the plurality of pressure chambers so as to be connected to the one of the plurality of pressure chambers, and is arranged in the first direction.

The common channel extends in the first direction and is connected to the plurality of throttles.

The common channel has a supply port and a terminal part.

The supply port is configured to supply a liquid to the common channel.

The terminal part is at least one of both end parts in the first direction of the common channel, and the supply port is not provided at the terminal part.

The terminal throttle which is one of the plurality of throttles and which is positioned closest to the terminal part among the plurality of throttles has a channel resistance same as a channel resistance of a throttle of the plurality of throttles different from the terminal throttle, and extends from a connection between the terminal throttle and one of the plurality of pressure chambers to the terminal part.

DETAILED DESCRIPTION

Here, in an ink-jet head described in Japanese Patent Application Laid-open No. 2004-223880, the ink tends to stagnate at the end part, of the common ink chamber, on the other side in the one direction. In view of this, in Japanese Patent Application Laid-open No. 2004-223880, the throttle part, among the plurality of throttle parts, which is located on the other side in the one direction of any other throttle parts is connected to the end part, of the common ink chamber, which is on the other side in the one direction, via the additional channel. Due to this, the ink inside the end part, of the common ink chamber, on the other side in the one direction is discharged or exhausted at a time of discharging or ejecting of the ink from the nozzle, etc., via the additional channel and the throttle part. With this, it is possible to make the ink to less likely to stagnate at the end part, of the common ink chamber, on the other side in the one direction.

In the ink-jet head of Japanese Patent Application Laid-open No. 2004-223880, however, each of pressure chambers, which are included in the plurality of pressure chambers and which are different from a pressure chamber located on the other side in the one direction of any other pressure chambers is connected to the common ink chamber only via the throttle part, whereas the pressure chamber located on the other side in the one direction of any other pressure chamber is connected to the common ink chamber via the throttle part and the additional channel. Accordingly, a channel resistance in a channel connecting the common ink chamber and each of the plurality of pressure chambers is different between the pressure chamber located on the other side in the one direction of any other pressure chambers and the pressure chambers different therefrom among the plurality of pressure chambers. As a result, there is such a fear that among the plurality of nozzles, any difference in the discharging characteristic (discharging property) of the ink might occur between a certain nozzle which is located on the other side in the one direction of any other nozzles and nozzles which are different from the certain nozzle.

An object of the present disclosure is to provide a liquid discharge head capable of making the liquid to less likely to stagnate at a terminal end part in a common channel, and of suppressing any variation in the discharging characteristic of the liquid among the nozzles.

In the following, an embodiment of the present disclosure will be explained.

<Overall Configuration of Printer 1>

Figure 1:
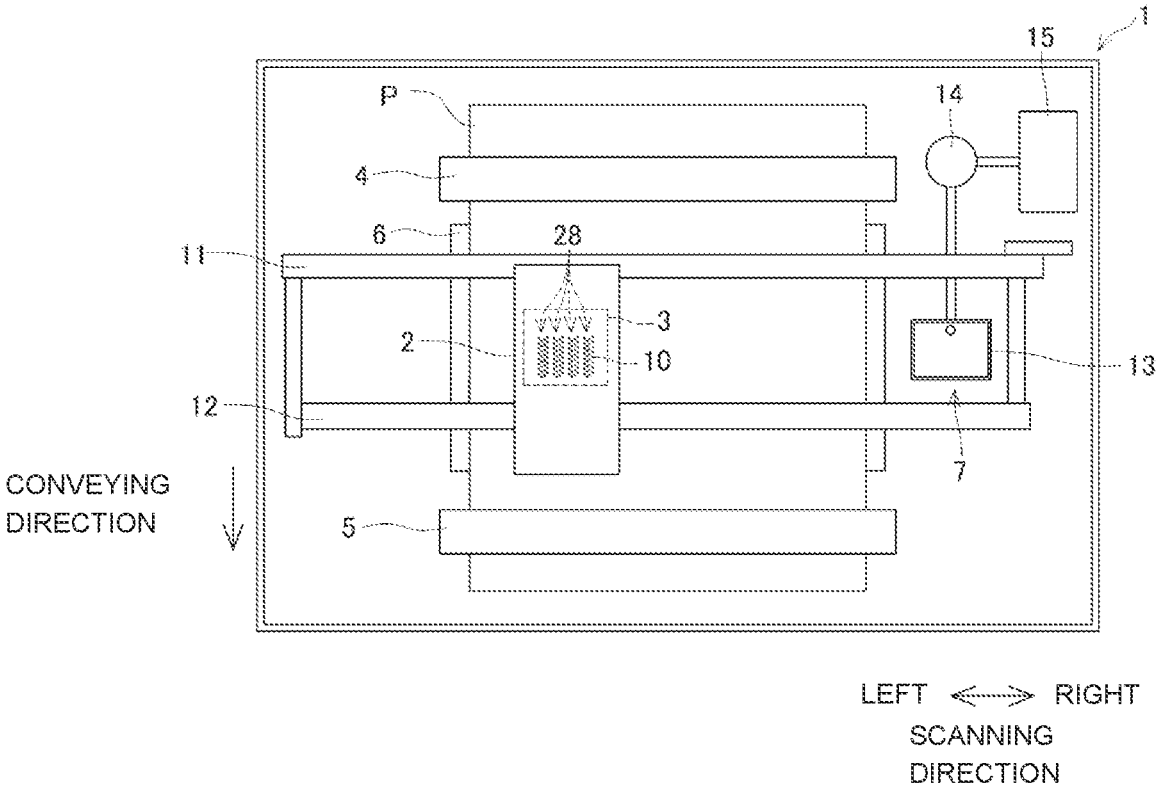
FIG. 1 is a view schematically depicting the configuration of a printer 1.

As depicted in FIG. 1, a printer 1 according to the present embodiment is provided with a carriage 2, an ink-jet head 3 (an example of a "liquid discharge head" of the invention), conveying roller pairs 4 and 5, a platen 6, and a purge unit 7.

The carriage 2 is supported by two guide rails 11 and 12 extending in a horizontal scanning direction. The carriage 2 moves in the scanning direction (an example of a "second direction" of the present invention) along the guide rails 11 and 12. Note that in the following explanation, the right side and the left side in the scanning direction will be defined as depicted in FIG. 1.

The ink-jet head 3 is attached to or mounted on the carriage 2. The ink-jet head 3 discharges an ink from a plurality of nozzles 10 formed in a lower surface of the ink-jet head 3. The plurality of nozzles 10 form four nozzle groups 28 arranged side by side in the scanning direction, as will be described later on. Further, black, yellow, cyan, and magenta inks are discharged from the plurality of nozzles 10. First, second, third and fourth nozzle groups 28 from the right discharge black, yellow, cyan and magenta inks, respectively. The configuration of the ink-jet head 3 will be explained in detail later on.

The conveying roller pair 4 is arranged on the upstream side of the ink-jet head 3 in a conveying direction (an example of a "first direction" of the present invention) which is horizontal and orthogonal to the scanning direction. The conveying roller pair 5 is arranged on the downstream side of the ink-jet head 3 in the conveying direction. Each of the conveying roller pairs 4 and 5 is formed of a pair of rollers extending in the scanning direction and arranged side by side in the vertical direction. Each of the conveying roller pairs 4 and 5 rotates in a state that each of the conveying roller pairs 4 and 5 sandwiches or nips a recording paper sheet (recording paper) P between the above-described pair or rollers so as to convey the recording paper P in the conveying direction.

The platen 6 is arranged between the conveying roller pair 4 and the conveying roller pair 5 in the conveying direction, and is positioned at a location below or under the ink-jet head 3. The platen 5 is capable of facing (being opposite to) the plurality of nozzles 10 of the ink-jet head 3 which is movable in the scanning direction together with the carriage 2; the platen 6 extends in the scanning direction over the entire length of the recording paper sheet P which is (being) conveyed by the conveying roller pairs 4 and 5, and supports the recording paper sheet P from therebelow.

Further, in the printer 1, an image can be recorded on the recording sheet P by repeatedly or alternately executing a recording pass of causing the recording head 3 to discharge or eject the ink(s) from the plurality of nozzles 10 toward the recording paper sheet P while moving the carriage 2 in the scanning direction, and a conveying operation of causing the conveying roller pairs 4 and 5 to convey the recording paper sheet P in the conveying direction.

The purge unit 7 includes a cap 13, a suction pump 14 and a waste liquid tank 15. The cap 13 is arranged on the right side of the platen 6. In a state that the carriage 2 is located at a maintenance position which is on the right side of the platen 6, the plurality of nozzles 10 of the ink-jet head 3 face the cap 13. Further, the cap 13 is capable of being lifted and lowered by a non-illustrated lifting/lowering mechanism in the vertical direction; in a case that the cap 13 is lifted in a state that the carriage 2 is located at the maintenance position, there is provided a capping state that the plurality of nozzles 10 of the ink-jet head 3 are covered by the cap 13. The suction pump 14 is, for example, a tube pump, etc., and is connected to the cap 13 and the waste liquid tank 15.

Further, the purge unit 7 is capable of performing a suction purge of driving the suction pump 14 in the above-described capping state to thereby discharge or exhaust the ink inside the ink-jet head 3 from the plurality of nozzles 10 of the ink-jet head 3.

Note that although the cap 13 is configured to coverall the plurality of nozzles 10 together, the configuration of the cap 13 is not limited to or restricted by this. For example, it is allowable that the cap 13 is partitioned into a part covering nozzles 10 constructing the rightmost nozzle group 28 for discharging the blank ink, and another part covering nozzles 10 constructing three nozzle groups 28 on the left side for discharging the color (yellow, cyan and magenta) inks. Further, it is allowable to provide such a configuration that one part, among these two parts, can be selectively connected to the suction pump 14. In such a case, it is possible to perform a suction purge of discharging or exhausting the black ink inside the ink-jet head 3 by driving the suction pump 14 in a state that the part, of the cap 13, covering the nozzles 10 for discharging the black ink is connected to the suction pump 14. Furthermore, it is possible to perform a suction purge of discharging or exhausting the color inks inside the ink-jet head 3 by driving the suction pump 14 in a state that the another part, of the cap 13, covering the nozzles 10 for discharging the color inks is connected to the suction pump 14.

<Ink-Jet Head 3>

Figure 2:
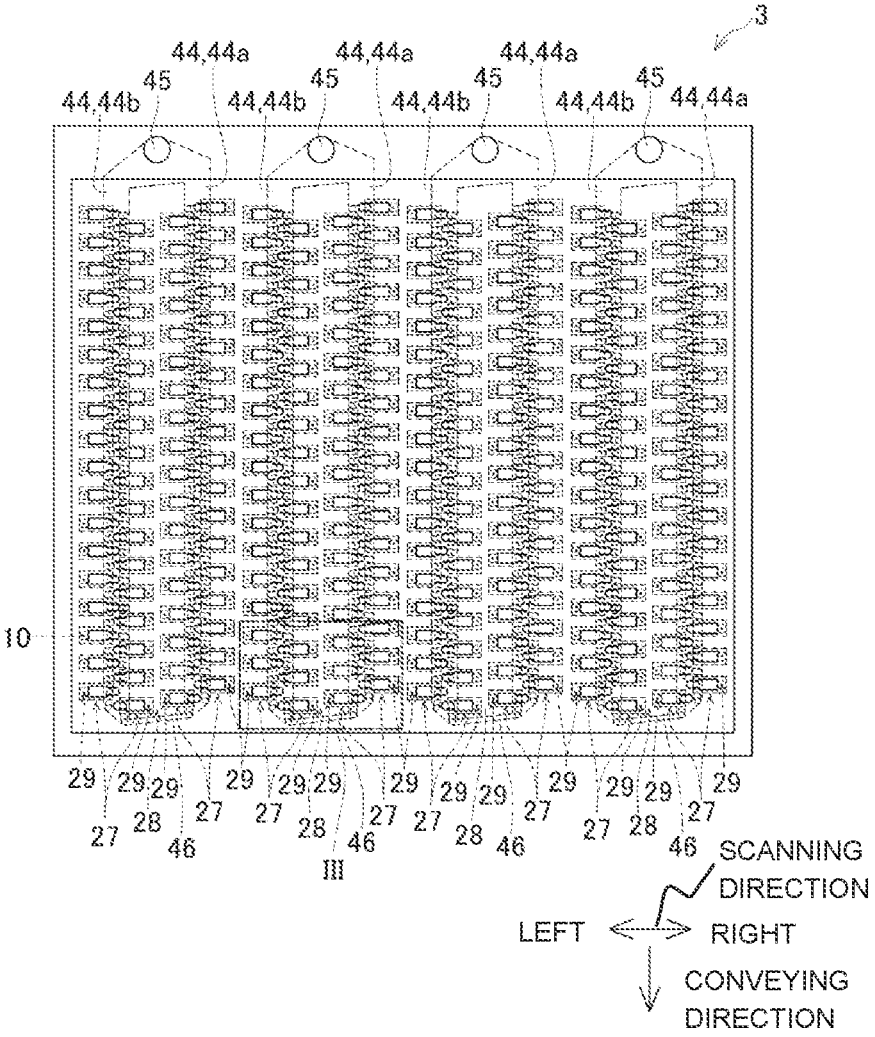
FIG. 2 is a plan view of an ink-jet head 3 in FIG. 1.
Figure 3:
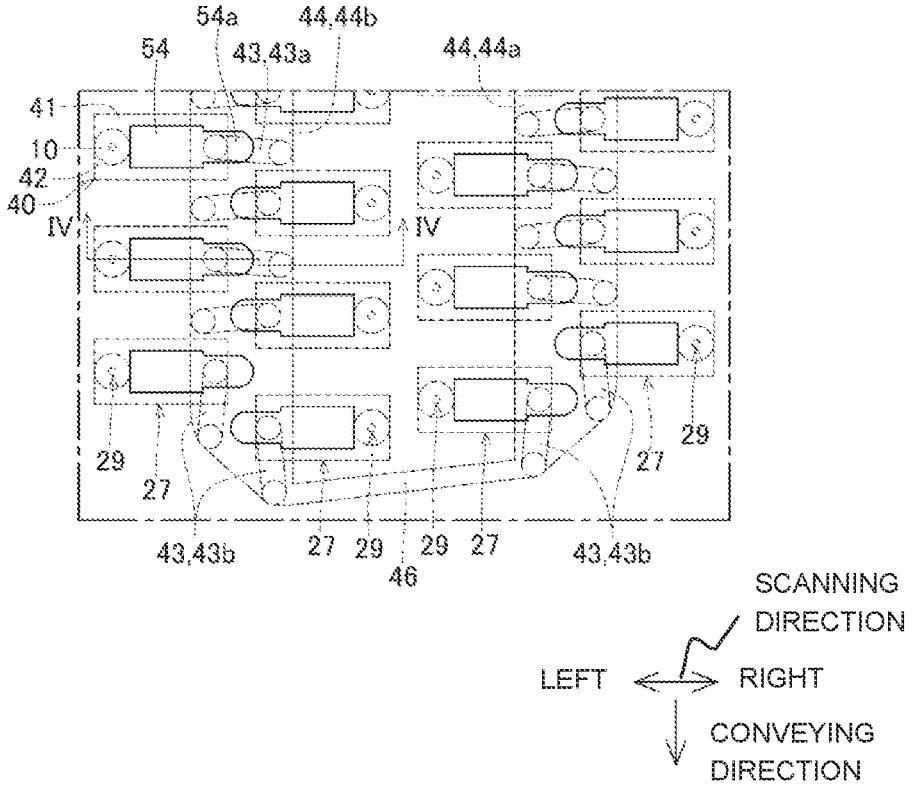
FIG. 3 is an enlarged view of a III part in FIG. 2.
Figure 4:
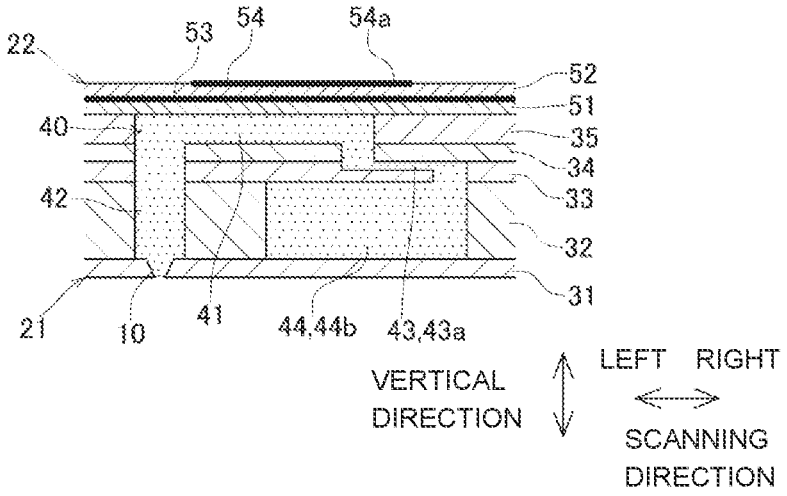
FIG. 4 is a cross-sectional view taken along a line IV-IV in FIG. 3.

Next, the configuration of the ink-jet head 3 will be explained in detail. As depicted in FIGS. 2 to 4, the ink-jet head 3 is provided with a channel unit 21 and a piezoelectric actuator 22.

<Channel Unit 21>

The channel unit 21 is formed by stacking five plates 31 to 35 from a lower position in this order. The plate 31 is formed, for example, of a synthetic resin material such as polyimide. The plates 32 to 35 are formed, for example, of a metallic material such as stainless steel. The channel unit 21 has the plurality of nozzles 10, a plurality of pressure chambers 41, a plurality of descenders 42, a plurality of throttles 43, eight pieces of a common channel 44, and four pieces of a bypass channel 46.

The plurality of nozzles 10 are formed in the plate 31. The plurality of nozzles 10 are aligned (arranged) in the conveying direction with a constant nozzle spacing distance therebetween to thereby form a nozzle row (nozzle array) 29. Further, in the plate 31, four pieces of the nozzle row 29 are arranged side by side in the scanning direction to thereby form a nozzle group 28. Furthermore, in the plate 31, four pieces of the nozzle group 28 are arranged side by side in the scanning direction.

Moreover, in each of the nozzle groups 28, nozzles 10 constructing a leftmost nozzle row 29 are shifted to the downstream side in the conveying direction by a length one fourth of the above-described nozzle spacing distance with respect to nozzles 10 constructing a rightmost nozzle row 29. Further, nozzles 10 constructing a nozzle row 29 which is a second row from the right are shifted to the downstream side in the conveying direction by a length one fourth of the above-described nozzle spacing distance with respect to the nozzles 10 constructing the leftmost nozzle row 29. Furthermore, nozzles 10 constructing a nozzle row 29 which is a second row from the left are shifted to the downstream side in the conveying direction by a length one fourth of the above-described nozzle spacing distance with respect to the nozzles 10 constructing the nozzle row 29 which is the second from the right. With this, the plurality of nozzles 10 constructing the four nozzle rows 29 of each of the four nozzle groups 28 are arranged in the conveying direction at the spacing distance which is one fourth the above-described nozzle spacing distance.

The plurality of pressure chambers 41 are formed in the plate 35. Each of the plurality of pressure chambers 41 has a rectangular shape having a planar shape of which longitudinal direction is the scanning direction. Further, each of the plurality of pressure chambers 41 is provided individually with respect to one of the plurality of nozzles 10; an end part on one side in the scanning direction of each of the plurality of pressure chambers 41 overlaps, in the vertical direction, with one of the plurality of nozzles 10 corresponding thereto. Here, the term "end part on one side in the scanning direction of each of the plurality of pressure chambers 41" means a right end part with respect to pressure chambers 41 corresponding to the first and third nozzle rows 29 from the right in each of the four nozzle groups 28, and means a left end part with respect to pressure chambers 41 corresponding to the second and fourth nozzle rows 29 from the right in each of the four nozzle groups 28.

The plurality of descenders 42 are formed across the plates 32 to 34. Each of the plurality of descenders 42 are provided on each of a set of the nozzle 10 and the pressure chamber 41 corresponding to the nozzle 10. Each of the plurality of descenders 42 extends while penetrating the plates 32 to 34 in the vertical direction, and connects the nozzle 10 corresponding to the descender 42 to the end part on the one side in the scanning direction of the pressure chamber 41 corresponding to the descender.

The plurality of throttles 43 are formed in an upper part of the plate 33. Each of the plurality of throttles 43 is provided individually with respect to one of the plurality of pressure chambers 41; an end part on one side in the scanning direction of each of the plurality of throttles 43 overlaps, in the vertical direction, with an end part on the other side in the scanning direction of one of the plurality of pressure chambers 41 corresponding thereto. Here, the term "end part on the other side in the scanning direction of each of the plurality of pressure chambers 41" means a left end part with respect to pressure chambers 41 corresponding to the first and third nozzle rows 29 from the right in each of the four nozzle groups 28, and means a right end part with respect to pressure chambers 41 corresponding to the second and fourth nozzle rows 29 from the right in each of the four nozzle groups 28.

Further, the end part of each of the plurality of throttles 43 extend penetrating, in the vertical direction, the plate 34 from the upper surface of the plate 33; an upper end of the end part of each of the plurality of throttles 43 is connected to the end part on the other side in the scanning direction of a pressure chamber 41 corresponding thereto.

Furthermore, each of throttles 43*a* (an example of "throttle different from the terminal throttle" in the present invention), which are included in the plurality of throttles 43 and each of which corresponds to a nozzle 10 different from a nozzle 10 located on the downstream-most side in the conveying direction (an example of "second side in a first direction" of the present invention) in each of the four nozzles rows 29 extends from a connection part thereof with respect to the pressure chamber 41 along a straight line which is inclined to some extent with respect to (relative to) the scanning direction, and is not curbed or bent in its path. Further, each of the throttles 43*a* extends while penetrates the plate 33 in the vertical direction at an end part thereof which is on an opposite side to the connecting part with respect to the pressure chamber 41; a lower end of the end part is connected to the common channel 44, as will be described later on.

On the other hand, a throttle 43*b* (an example of a "terminal throttle" in the present invention), which is included in the plurality of throttles 43 and which corresponds to the nozzle 10 located on the downstream-most side in the conveying direction in each of the four nozzles rows 29 extends from a connection part thereof with respect to the pressure chamber 41 along a straight line which is inclined to some extent with respect to (relative to) the conveying direction toward an end part on the downstream side in the conveying direction of the common channel 44, and is not curbed or bent on the path of the throttle 43*b*. Further, the throttle 43*b* extends while penetrates the plate 33 in the vertical direction at an end part thereof which is on an opposite side to the connecting part with respect to the pressure chamber 41; a lower end of the end part is connected to the common channel 44, as will be described later on.

Here, although the throttle 43*a* and the throttle 43*b* have a same shape, but a direction in which the throttle 43*a* extends from the connecting part thereof with respect to the pressure chambers 41 and a direction in which the throttle 43*b* extends from the connecting part thereof with respect to the pressure chamber 41 are different from each other. Namely, the throttle 43*a* and the throttle 43*b* have a same length and a same channel resistance. For example, each of the throttle 43*a* and the throttle 43*b* has a length which is in a range of 0.5 mm to 1.0 mm; and has channel resistance in a range of 10 MPa×sec/cm$^3$ to 20 MPa×sec/cm$^3$.

Further, an individual channel 40 is formed of a nozzle 10, a pressure chamber 41, a descender 42 and a throttle 43 which correspond to one another. Furthermore, in the channel unit 21, a plurality of individual channel rows 27 are arranged side by side in the scanning direction corresponding to the four nozzle rows 29; each of the plurality of individual channel rows 27 is formed by aligning a plurality of pieces of the individual channel 40 in the conveying direction.

The eight common channels 44 are formed in the plate 32. The first to eighth common channels 44 from the right are provided with respect to individual channel rows 27 which are first and second from the right, third and fourth from the right, fifth and sixth from the right, seventh and eighth from the right, ninth and tenth from the right, eleventh and twelfth from the right, thirteenth and fourteenth from the right, and fifteenth and sixteenth from the right, respectively. Each of the eight common channels 44 extends in the conveying direction over individual channels 40 constructing the two individual channel rows 27 corresponding to the common channel 44. Further, each of the eight common channels 44 is connected to end parts, of the throttles 43 constructing the individual channels 40 corresponding to the common channel 44, each of the end parts being on the opposite side to the connecting part with respect to the pressure chamber 41.

Furthermore, an end part on the downstream side in the conveying direction of each of the eight common channels 44 is apart from a pressure chamber 41 of an individual channel 40 which is included in the plurality of individual channels 40 connected to the common channel 44 and which is located on the downstream-most side in the conveying direction by a distance, for example, approximately in a range of 1.0 mm to 2.0 mm. Here, in each of the four nozzle groups 28, since the plurality of nozzles 10 are arranged as described above, the nozzles 10 constructing the two nozzle rows 29 on the left side are shifted toward the downstream side in the conveying direction with respect to the nozzles 10 constructing the two nozzle rows 29 on the right side. Accordingly, among the eight common channels 44, an end part on the downstream side in the conveying direction of each of even-numbered common channels 44 from the right is located on the downstream side in the conveying direction than an end part on the downstream side in the conveying direction of each of odd-numbered common channels 44 from the right.

Moreover, the ink is supplied from each of the eight common channels 44 to the individual channels 40 constructing the individual channel rows 27 corresponding to the common channel 44. Furthermore, among the eight common channels 44, the two common channels 44 which are first and second from the right, the two common channels 44 which are third and fourth from the right, the two common channels 44 which are fifth and sixth from the right, and the two common channels 44 which are seventh and eighth from the right are connected to each other at end parts thereof on the upstream side in the conveying direction (an example of "first side in a first direction" of the present disclosure). Moreover, each of upstream end parts of the two connected common channels 44 is provided with a supply port 45; the ink is supplied to these two common channels 44 from the supply port 45.

Further, among the eight common channels 44, common channels 44*a* which are odd-numbered from the right each have an inner wall surface on the left side which extends substantially parallel to the conveying direction at an end part of the common channel 44*a* on the downstream side in the conveying direction, whereas have an inner wall surface on the right side (right-side inner wall surface) which extends while being inclined with respect to (relative to) the conveying direction so that a position of a section of the right-side inner wall surface in the scanning direction shifts to the left as the section is shifted to the downstream in the conveying direction, at the end part of the common channel 44*a* on the downstream side in the conveying direction. With this, the common channel 44*a* has a length in the scanning direction, at the end part (an example of a "terminal part" of the present invention) on the downstream side in the conveying direction, which becomes to be shorter toward the downstream side in the conveying direction.

Furthermore, two throttles 43*b* corresponding to two individual channel rows 27 corresponding to each of the common channels 44*a* are connected to the end part on the downstream side in the conveying direction of each of the common channels 44*a*. Furthermore, a throttle 43*b* which is included in the two throttles 43*b* and which in on the left side is connected to a tip end part, which is included in the end part on the downstream side in the conveying direction of the common channel 44*a* and at which the length (width) of the end part in the scanning direction is the shortest.

The length in the scanning direction of the tip end part, which is included in the end part on the downstream side in the conveying direction of the common channel 44*a*, 44*b* and at which the length (width) of the end part in the scanning direction is the shortest, is, for example, in a range of 0.17 mm to 0.7 mm.

Further, among the eight common channels 44, common channels 44*b* which are even-numbered from the right each have an inner wall surface on the right side which extends substantially parallel to the conveying direction at an end part of the common channel 44*b* on the downstream side in the conveying direction, whereas have an inner wall surface on the left side (left-side inner wall surface) which extends while being inclined with respect to (relative to) the conveying direction so that a position of a section of the left-side inner wall surface in the scanning direction shifts to the right as the section is shifted to the downstream in the conveying direction, at the end part of the common channels 44*b* on the downstream side in the conveying direction. With this, the common channel 44*b* has a length in the scanning direction, at the end part (an example of the "terminal part" of the present invention) on the downstream side in the conveying direction which becomes to be shorter toward the downstream side in the conveying direction.

Two throttles 43*b* corresponding to two individual channel rows 27 corresponding to each of the common channels 44*b* are connected to the end part on the downstream side in the conveying direction of each of the common channels 44*b*. Furthermore, a throttle 43*b* which is included in the two throttles 43*b* and which in on the right side is connected to a tip end part, which is included in the end part on the downstream side in the conveying direction of the common channel 44*b* and at which the length (width) of the end part in the scanning direction is the shortest.

The four bypass channels 46 are formed in the plate 32. The first to fourth bypass channels 46 from the right connect the end parts on the downstream side in the conveying direction of the two common channels 44 which are first and second from the right, third and fourth from the right, fifth and sixth from the right, and seventh and eighth from the right, respectively. Further, each of the bypass channels 46 is opened in the inner wall surface on the left side of the tip end part, of the common channel 44*a*, which is included in the end part on the downstream side in the conveying direction of the common channel 44*a* and at which the length of the end part in the scanning direction is made to be shortest, and in the inner wall surface on the right side of the tip end part, of the common channel 44*b*, which is included in the end part on the downstream side in the conveying direction of the common channel 44*b* and at which the length of the end part in the scanning direction is made to be shortest.

Namely, each of the bypass channels 46 is connected to a part, of the end part on the downstream side in the conveying direction of the common channel 44*a*, which is shifted to the left side from the center in the scanning direction, and is connected to a part, of the end part on the downstream side in the conveying direction of the common channel 44*b*, which is shifted to the right side from the center in the scanning direction.

Further, as described above, among the eight common channels 44, the end part on the downstream side in the conveying direction of each of the even-numbered common channels 44 from the right is located on the downstream side in the conveying direction than the end part on the downstream side in the conveying direction of each of the odd-numbered common channels 44 from the right. Corresponding to this, each of the bypass channels 46 is inclined with respect to the scanning direction so that a position of a section of each of the bypass channels 46 in the conveying direction shifts to the downstream as the section is shifted to the left in the scanning direction. Further, the cross-sectional area of a cross section, of each of the bypass channels 46*a*, which is orthogonal to the length or extending direction of the bypass channel is, for example, in a range of 0.005 $mm^2$ to 0.05 $mm^2$.

Further, since each of the bypass channels 46 is connected to the common channels 44*a* and 44*b* as described above, the throttle 43*b* which is included in the two throttles 43*b* connected to the common channel 44*a* and which is on the left side is connected to the part, of the end part on the downstream side in the conveying direction of the common channel 44*a*, which is shifted to the side of the bypass channel (the left side) from the center in the scanning direction of the end part on the downstream side in the conveying direction of the common channel 44*a*. Further, the throttle 43*b* which is included in the two throttles 43*b* connected to the common channel 44*b* and which is on the right side is connected to the part, of the end part on the downstream side in the conveying direction of the common channel 44*b*, which is shifted to the side of the bypass channel (the right side) from the center in the scanning direction of the end part on the downstream side in the conveying direction of the common channel 44*b*.

<Piezoelectric Actuator 22>

The piezoelectric actuator 22 is provided with a vibration plate 51, a piezoelectric layer 52, a common electrode 53 and a plurality of individual electrodes 54.

The vibration plate 51 is formed of a piezoelectric material containing, as a main component thereof, lead zirconate titanate which is a mixed crystal of lead titanate and lead zirconate, is arranged on the upper surface of the channel unit 21 (the plate 35), and covers the plurality of pressure chambers 41. Note that unlike the piezoelectric layer 52 which is to be explained next, the vibration plate 51 is not limited to being formed of the piezoelectric material. For example, the vibration plate 51 may be formed of an insulative material which is different from the piezoelectric material. The piezoelectric layer 52 is formed of a piezoelectric material and is arranged on the upper surface of the vibration plate 51.

The common electrode 53 is arranged on a surface or plane between the vibration plate 51 and the piezoelectric layer 52, and extends continuously over the plurality of pressure chambers 41. The common electrode 53 is connected to a non-illustrated power source via a non-illustrated wiring member, etc., and is maintained at the ground potential.

The plurality of individual electrodes 54 are provided on the upper surface of the piezoelectric layer 52. Each of the plurality of individual electrodes 54 is provided individually with respect to one of the plurality of pressure chambers 41, and is overlapped, in the vertical direction, with a central part of one of the plurality of pressure chambers 41 corresponding thereto. Further, each of the plurality of individual electrodes 54 is provided with a tip end part on one side in the scanning direction which extends up to a position at which the tip end part does not overlap, in the vertical direction, with one of the plurality of pressure chambers 41; the tip end part of each of the plurality of individual electrodes 54 becomes a connection terminal 54*a*. The connection terminal 54*a* is connected to a non-illustrated driver IC via a non-illustrated wiring member. Further, either one of the ground potential and a predetermined driving potential is selectively applied by the driver IC individually to each of the plurality of individual electrodes 54.

Further, in the piezoelectric actuator 22, a part, of the piezoelectric layer 52, which is sandwiched between the common electrode 53 and each of the plurality of individual electrodes 54, is polarized in a thickness direction thereof.

Here, an explanation will be given about a method of driving the piezoelectric actuator 22 and to discharge or eject the ink from the nozzles 10. In a case that discharge of the ink(s) from the nozzles 10 is not performed, in the piezoelectric actuator 22, all the plurality of individual electrodes 54 are maintained at the ground potential by the non-illustrator driver IC.

In a case of causing the ink to be discharged from a certain nozzle 10, among the plurality of nozzles 10, the potential of an individual electrode 54 among the plurality of individual electrodes 54 and corresponding to the certain nozzle 10 is switched from the ground potential to the driving potential. Then, due to the difference in potential between the individual electrode 54 and the common electrode 53, an electric field parallel to the polarization direction is generated in the part, of the piezoelectric layer 52, which is sandwiched by the individual electrode 54 and the common electrode 53. Due to this electric field, the above-described part of the piezoelectric layer 52 contracts in a plane direction (the scanning direction and the conveying direction), thereby deforming parts, of the vibration plate 51 and the piezoelectric layer 52, respectively, which overlap with a certain pressure chamber 41, among the plurality of pressure chamber 41, corresponding to the certain nozzle 10 to project toward the side of the certain pressure chamber 41. The deformation decreases the volume of the certain pressure chamber 41, which in turn applies the pressure to the ink inside the certain pressure chamber 41, thereby discharging the ink from the certain nozzle 10 communicating with the certain pressure chamber 41. Further, after the discharge of the ink from the certain nozzle 10, the potential of the individual electrode 54 is returned to the ground potential, thereby returning the vibration plate 51 and the piezoelectric layer 52 to states thereof before the deformation.

<Effects>

Figure 5A:
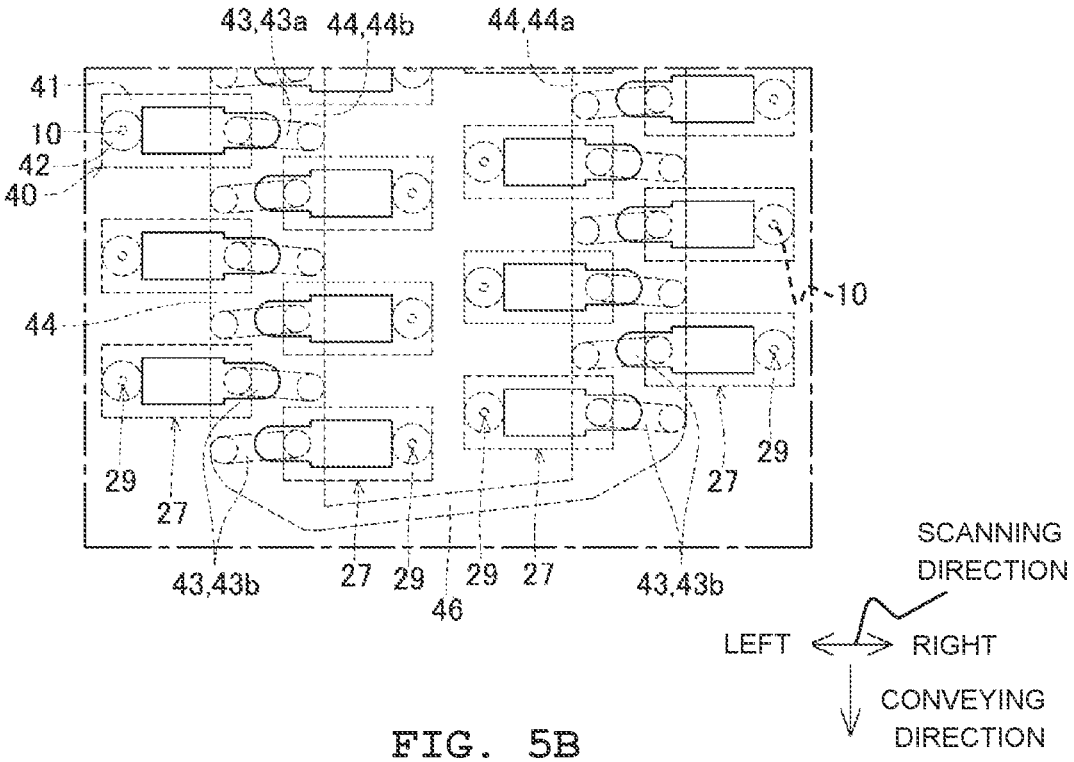
FIG. 5A is a view for explaining a configuration wherein all throttles extend along a scanning direction.

Here, a configuration is considered wherein, unlike in the present embodiment, the throttles 43*b* extend along the scanning direction, in a similar manner as the throttles 43*a*, as depicted in FIG. 5A. In this configuration, while the ink is supplied to the common channel 44 from the supply port 45 provided on the end part on the upstream side in the conveying direction of the common channel 44, the throttle 43 is not connected to the end part on the downstream side in the conveying direction of the common channel 44. Accordingly, in either one of the case of discharging the ink from the nozzles 10 and of the case of performing the suction purge, the flow of the ink is less likely to occur at the end part on the downstream side in the conveying direction of the common channel 44, and thus the ink is more likely to stagnate at the end part on the downstream side in the conveying direction of the common channel 44.

Figure 5B:
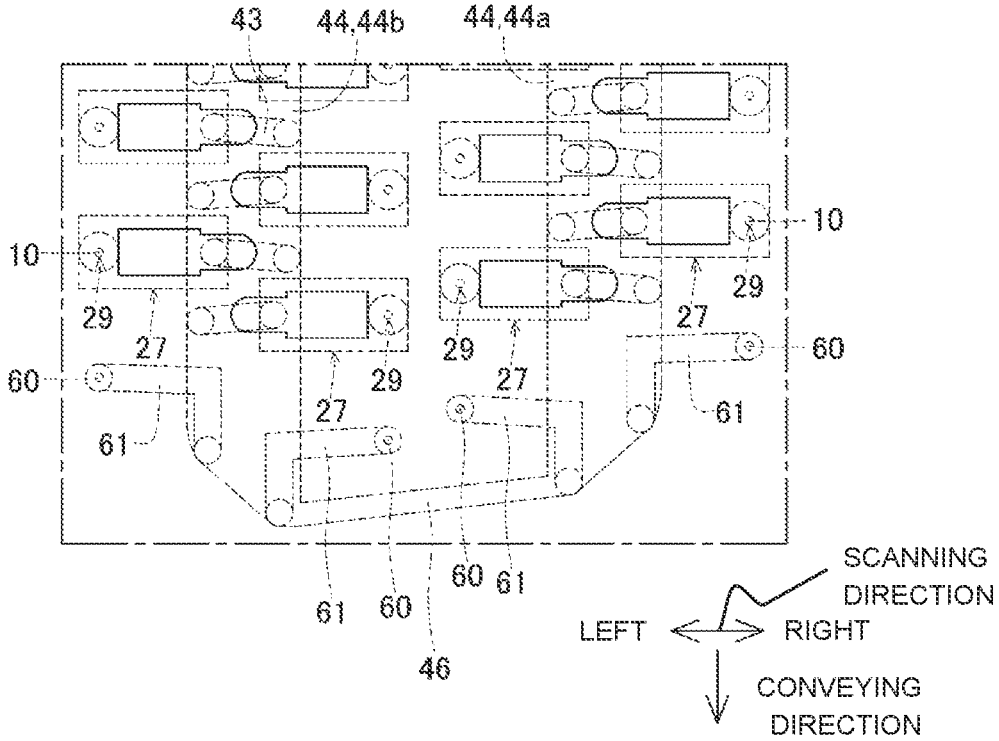
FIG. 5B is a view for explaining a configuration provided with a dummy nozzle.

Further, a configuration is considered wherein, unlike the present embodiment, all the throttles 43 extend along the scanning direction, a dummy nozzle 60 is provided at a location further on the downstream side in the conveying direction of a downstream-most nozzle 10 in the conveying direction of each of the nozzle rows 29, and the dummy nozzle 60 and the end part on the downstream side in the conveying direction of the common channel 44 is connected by a dummy channel 61, as depicted in FIG. 5B. In this configuration, in a case that the suction purge is performed, the ink is discharged or exhausted also from the dummy nozzle 60, in addition to the nozzles 10; in this situation, the ink in the end part on the downstream side in the conveying direction of the common channel 44 is discharged.

In the configuration of FIG. 5B, however, in the case of discharging the ink from the nozzles 10, the flow of the ink is less likely to occur at the end part on the downstream side in the conveying direction of the common channel 44, and thus the ink is more likely to stagnate at the end part on the downstream side in the conveying direction of the common channel 44. In a case that the ink stagnates at the end part on the downstream side in the conveying direction of the common channels 44, there is such a fear that the viscosity of the ink might be increased at the end part on the downstream side in the conveying direction of the common channels 44, that this viscous ink flows into a part, of the common channels 44, on the upstream side in the conveying direction then flows into the individual channels 40, and that the ink might not be normally discharged from the nozzles 10.

In contrast, in the present embodiment, the throttle 43*b* extends from the connection part with respect to the pressure chamber 41 toward the end part on the downstream side in the conveying direction of the common channel 44, and thus the throttle 43*b* is connected to the end part on the downstream side in the conveying direction of the common channel 44 or in the vicinity of the end part. With this, at the time of discharging the ink from the nozzles 10 corresponding to the throttle 43*b*, and at the time of performing the suction purge, the ink and any air bubble(s) in the end part on the downstream side in the conveying direction of the common channel 44 are discharged or exhausted via the throttle 43*b* and via the pressure chamber 41 and the nozzle 10 corresponding to the throttle 43*b*. With this, it is possible to make the ink to less likely to stagnate at the end part on the downstream side in the conveying direction of the common channel 44. Further, in the present embodiment, since the channel resistance in the throttle 43*b* is same as the channel resistance in the throttle 43*a*, it is possible to suppress any occurrence of the difference in the discharging characteristic of the ink among the nozzles 10.

Further, in the present embodiment, since the throttle 43*b* extends along the straight line, and is not curbed or bent at the path thereof, any air bubble(s), etc., in the ink is/are less likely to be caught at the path of the throttle 43*b*.

Furthermore, in the present embodiment, since the throttle 43*b* is configured to have the shape same as that of the throttle 43*a*, and to extend from the connection part thereof with respect to the pressure chamber 41 in the direction which is different from that of the throttle 43*a*, thereby making it possible to make the channel resistance in the throttle 43*b* to be same as that in the throttle 43*a*. This makes it possible to effectively suppress the occurrence of any variation or fluctuation in the discharging characteristic of the liquid among the nozzles. Further, it is possible to simplify the structure of the channel in the ink-jet head 3.

Moreover, in the present embodiment, the end parts on the downstream side in the conveying direction of the common channel 44*a* and the common channel 44*b* which are adjacent in the scanning direction are connected to each other by the bypass channel 46. With this, for example, in such a case that the ink is discharged in a large amount in a short period of time from the nozzles 10 corresponding to one of the common channels 44*a* and 44*b* and that a large change in the pressure occurs in the ink inside the one of the common channels 44 and 44*b*, it is possible to allow the change in the pressure occurred in the ink inside the one of the common channels 44 and 44*b* to escape to the ink inside the other of the common channels 44 and 44*b*. With this, it is possible to suppress the occurrence of the variation or fluctuation in the pressure inside the common channel(s) 44.

Further, in a case that the bypass channel 46 is provided, a connecting part between a common channel 44 and the bypass channel 46 is made to be narrow in many cases due to, for example, any reason related to the space, etc. Accordingly, any air bubble(s) is likely to accumulate at the connecting part between the common channel 44 and the bypass channel 46. In the present embodiment, each of the bypass channels 46 is connected to the part, of the end part on the downstream side in the conveying direction of each of the common channels 44 (44*a* and 44*b*), which is shifted from the center in the scanning direction. Corresponding to this, the throttle 43*b* is connected to the part, of the end part on the downstream side in the conveying direction of the common channel 44, which is shifted to the side of the bypass channel 46 from the center in the scanning direction of the end part on the downstream side in the conveying direction of the common channel 44. With this, the ink at the connecting part between the common channel 44 and the bypass channel 46 is allowed to easily flow, via the throttle 43*b*, to the pressure chamber 41 and the nozzle 10 corresponding to the throttle 43*b*. With this, it is possible to make the air bubble(s) to less likely to remain at the connecting part between the common channel 44 and the bypass channel 46.

Furthermore, in the present embodiment, the common channel 44 has the length in the scanning direction, at the end part on the downstream side in the conveying direction, which becomes to be shorter toward the downstream side in the conveying direction. With this, the flow rate of the ink becomes to be fast in a case that the ink flows into the end part on the downstream side in the conveying direction of the common channel 44, thereby making it possible to make the ink to less likely to stagnate at the end part on the downstream side in the conveying direction as much as possible.

Further, in the present embodiment, the ink is most likely to stagnate at the tip end part, which is included in the end part on the downstream side in the conveying direction of the common channel 44 and at which length of the end part in the scanning direction is the shortest. In view of this, in the present embodiment, the throttle 43*b* is connected to the tip end part, which is included in the end part on the downstream side in the conveying direction of the common channel 44 and at which the length of the end part in the scanning direction is the shortest. With this, it is possible to efficiently suppress any stagnation of the ink at the end part on the downstream side in the conveying direction of the common channel 44.

<Modification>

In the foregoing, the embodiment of the present disclosure has been explained. The present invention, however, is not limited to or restricted by the above-described embodiment, it is allowable to make a various kind of changes to the present disclosure, within the scope described in the claims.

In the above-described embodiment, the end part on the downstream side in the conveying direction of the common channel 44 has the length in the scanning direction which becomes to be shorter toward the downstream side in the conveying direction. Further, the throttle 43*b* is connected to the tip end part, of the end part on the downstream side in the conveying direction of the common channel 44, at which the length of the end part in the scanning direction is the shortest. The present disclosure, however, is not limited to or restricted by this.

For example, the throttle 43*b* may be connected to a part, of the end part on the downstream side in the conveying direction of the common channel 44, which is located on the upstream side to some extent in the conveying direction of the tip end part, at which the length of the end part in the scanning direction is the shortest.

Further, for example, the common channel 44 may have a length in the scanning direction which is substantially constant regardless of the position in the conveying direction.

Furthermore, in the above-described embodiment, the end parts on the downstream side in the conveying direction of the common channel 44*a* and the common channel 44*b* which are adjacent in the scanning direction are connected to each other by the bypass channel 46. Moreover, the bypass channel 46 is connected to the part, of the end part on the downstream side in the conveying direction of each of the common channels 44 (44*a* and 44*b*), which is shifted from the center in the scanning direction. Further, the ink-jet head 3 has the throttle 43*b* connected to the part, of the end part on the downstream side in the conveying direction of each of the common channels 44 (44*a* and 44*b*), which is shifted to the side of the bypass channel 46 from the center in the scanning direction of the end part on the downstream side in the conveying direction of the common channel 44*a* or 44*b*. The present disclosure, however, is not limited to this.

For example, the bypass channel 46 may be connected to a center part in the scanning direction of the end part on the downstream side in the conveying direction of the common channel 44. Further, any of the throttles 43*b* may be connected to the center part in the scanning direction of the end part on the downstream side in the conveying direction of the common channel 44.

Alternatively, it is allowable, for example, that the bypass channel 46 is connected to the part, of the end part on the downstream side in the conveying direction of the common channel 44, which is shifted from the center in the scanning direction, and that all the throttles 43*b* are connected to the center part in the scanning direction of the end part on the downstream side in the conveying direction of the common channel 44*a* or 44*b*, or to a part, of the end part on the downstream side in the conveying direction of the common channel 44*a* or 44*b*, which is on a side opposite to the bypass channel 46 with respect to the center in the scanning direction of the end part.

Still alternatively, it is allowable, for example, that the bypass channel 46 is connected to the center part in the scanning direction of the end part on the downstream side in the conveying direction of the common channel 44, and that all the throttles 43*b* are connected to the part, of the end part on the downstream side in the conveying direction of the common channel 44*a* or 44*b*, which is shifted from the center in the scanning direction.

Further, in the above-described embodiment, the ink-jet head 3 is provided with sets each formed of two pieces of the common channel in which an ink of the same color flows, and in each of the sets, the two pieces of the common channel are connected by one of the bypass channels. The present disclosure, however, is not limited to this. For example, it is allowable that the ink-jet head has not less than three common channels which are arranged side by side in the scanning direction and in which the ink of a same color flows, and that among these not less than three pieces common channels, end parts on the downstream side in the conveying direction of two common channels which are adjacent to each other are connected by a bypass channel. The ink-jet head 3 may be mounted on the carriage 2 such that each of the common channels 44 extends along the scanning direction.

Furthermore, it is allowable to omit the bypass channel 46 connecting the common channel 44*a* and the common channel 44*b*. Moreover, in such a case, the ink-jet head is not limited to having the plurality of common channels 44. For example, the ink-jet head may have one common channel and a plurality of individual channels connected to the one common channel.

Further, in the above-described embodiment, the throttle 43*b* has the shape which is same as the shape of the throttle 43*a*, and the throttle 43*b* extends in the direction from the connecting part with respect to the pressure chamber 41 which is different from that of the throttle 43*a*, thereby making the channel resistance in the throttle 43*a* and the channel resistance in the throttle 43*b* to be same. The present disclosure, however, is not limited to this.

For example, under a condition that the channel resistance in the throttle 43*a* and the channel resistance in the throttle 43*b* are same, it is allowable that between the throttle 43*a* and the throttle 43*b*, the elements which are different from the direction in which each of the throttle 43*a* and the throttle 43*b* extends from the connecting part thereof with respect to the pressure chamber 41, such as the length of each of the throttle 43*a* and the throttle 43*b* in the direction in which each of the throttle 43*a* and the throttle 43*b* extends, the cross-sectional area of the cross section orthogonal to the extending direction of each of the throttle 43*a* and the throttle 43*b*, etc., may be different.

Further, in the above-described embodiment, although each of the throttles 43*a* and 43*b* extends along the one straight line, and is not curbed or bent on the path thereof, the present disclosure is not limited to this. It is allowable that at least one of the throttles 43*a* and 43*b* is bent on the path thereof.

Furthermore, in the above-described embodiment, although the supply port 45 is provided on the end part on the upstream side in the conveying direction of the common channel 44, and the end part on the downstream side in the conveying direction of the common channel 44 is the terminal part at which the supply port is not provided, the present disclosure is not limited to this.

For example, it is allowable that a supply port is provided on a central part in the conveying direction of the common channel 44, and that the both ends in the conveying direction of the common channel are terminal parts at each of which the supply port is not provided. In such a case, it is allowable that a throttle 43 (an example of a "terminal throttle" of the present invention) constructing an individual channel 40 which is included in the individual channels 40 constructing the individual channel row 27 and which is located on the upstream-most side in the conveying direction is made to extend from the connecting part with respect to the pressure chamber 41 toward the upstream side in the conveying direction. Further, it is allowable that a throttle 43 (an example of the "terminal throttle" of the present invention) constructing an individual channel 40 which is included in the individual channels 40 constructing the individual channel row 27 and which is located on the downstream-most side in the conveying direction is made to extend from the connecting part with respect to the pressure chamber 41 toward the downstream side in the conveying direction.

Further, in the above-described embodiment, the throttles 43 of the individual channels 40 constructing two pieces of the individual channel row 27 are connected to one pieces of the common channel 44. The present disclosure, however, is not limited to this. It is allowable, for example, that the throttles 43 of the individual channels 40 constructing one piece of the individual channel row 27 are connected to one pieces of the common channel 44.

Furthermore, in the above-described example, only a throttle 43 (an example of the "terminal throttle" of the present invention) which is included in the throttles 43 constructing the individual channel row 27 and which is closest to the terminal part of the common channel 44 is made to extend from the connection part with respect to the pressure chamber 41 toward the terminal part. The present disclosure, however, is not limited to this. It is allowable, for example, that two or more throttles including the throttle closest to the terminal part of the common channel 44 and which are arranged side by side consecutively (continuously, adjacent to each other) in the conveying direction are each made to extend from the connecting part with respect to the pressure chamber 41 toward the terminal part.

Moreover, in the foregoing, although the explanation has been made regarding the example in which the present disclosure is applied to the ink-jet head configured to discharge or eject the ink from the nozzle(s), the present disclosure is not limited to this. The present disclosure is applicable also to a liquid discharge head configured to discharge a liquid different from the ink.

What is claimed is:

1. A liquid discharge head comprising:

a plurality of nozzles arranged in a first direction;

a plurality of pressure chambers each of which is provided individually with respect to one of the plurality of nozzles so as to communicate with the one of the plurality of nozzles, and which is arranged in the first direction;

a plurality of throttles each of which is provided individually with respect to one of the plurality of pressure chambers so as to be connected to the one of the plurality of pressure chambers, and which is arranged in the first direction; and a common channel extending in the first direction and connected to the plurality of throttles, wherein the common channel has:

a supply port configured to supply a liquid to the common channel, and a terminal part which is at least one of both end parts in the first direction of the common channel, the supply port being not provided at the terminal part; and a terminal throttle which is one of the plurality of throttles and which is positioned closest to the terminal part among the plurality of throttles has a channel resistance same as a channel resistance of a throttle of the plurality of throttles different from the terminal throttle, and extends from a connection between the terminal throttle and one of the plurality of pressure chambers to the terminal part, a distance in the first direction between the terminal part and a connection between the terminal throttle and the common channel being smaller than a distance in the first direction between the terminal part and the connection between the terminal throttle and the one of the plurality of pressure chambers.

2. The liquid discharge head according to claim 1, wherein the supply port is provided at an end part on a first side in the first direction of the common channel;

an end part on a second side in the first direction of the common channel is the terminal part;

the terminal throttle is a throttle, of the plurality of throttles, positioned in the first direction on the second side of all other throttle of the plurality of throttles; and the terminal throttle extends, toward the second side in the first direction, from the connection between the terminal throttle and the one of the plurality of pressure chambers.

3. The liquid discharge head according to claim 1, wherein the terminal throttle extends along one straight line.

4. The liquid discharge head according to claim 1, wherein a length of the terminal throttle is same as a length of the throttle of the plurality of throttles different from the terminal throttle.

5. The liquid discharge head according to claim 1, wherein a shape of the terminal throttle is same as a shape of the throttle of the plurality of throttles different from the terminal throttle, and a direction in which the terminal throttle extends from the connection between the terminal throttle and the one of the plurality of pressure chambers is different from a direction in which the throttle different from the terminal throttle extends from a connection between the throttle different from the terminal throttle and one of the plurality of pressure chambers.

6. The liquid discharge head according to claim 1, wherein the plurality of nozzles, the plurality of pressure chambers and the plurality of throttles are provided so as to construct a plurality of individual channel rows each of which includes a plurality of individual channels arranged in the first direction, the plurality of individual channel rows being arranged side by side in a second direction orthogonal to the first direction;

each of the plurality of individual channels includes one of the plurality of nozzles, one of the plurality of pressure chambers and one of the plurality of throttles; and the common channels is a plurality of channels which is arranged side by side in the second direction, each of the plurality of channels being connected to throttles included in the plurality of individual channels constructing at least one of the plurality of individual channel rows;

the liquid discharge head further comprising a bypass channel connecting the terminal part of a first one of two channels of the plurality of channels and the terminal part of a second one of the two channels, the two channels being adjacent to each other in the second direction.

7. The liquid discharge head according to claim 6, wherein the bypass channel is connected to the terminal part of the first one of the two channels, at a position shifted to a first side in the second direction from a center of the terminal part of the first one of the two channels; and the terminal throttle is connected to the terminal part of the first one of the two channels on the first side in the second direction of the center of the terminal part of the first one of the two channels.

8. The liquid discharge head according to claim 1, wherein the terminal part has a length, in a second direction orthogonal to the first direction, which becomes to be shorter toward a tip in the first direction of the common channel.

9. The liquid discharge head according to claim 8, wherein the terminal throttle is connected to a part, of the terminal part of the common channel, at which length of the terminal part in the second direction is shortest.

* * * * *